US007591318B2

(12) United States Patent
Tilghman

(10) Patent No.: US 7,591,318 B2
(45) Date of Patent: Sep. 22, 2009

(54) METHOD FOR REMOVING A SEALING PLUG FROM A WELL

(75) Inventor: Stephen E. Tilghman, Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 179 days.

(21) Appl. No.: 11/489,853

(22) Filed: Jul. 20, 2006

(65) Prior Publication Data

US 2008/0017379 A1 Jan. 24, 2008

(51) Int. Cl.
*E21B 29/02* (2006.01)

(52) U.S. Cl. ..... 166/376; 166/63; 166/299; 166/387

(58) Field of Classification Search ..... 166/63, 166/299, 376, 387
See application file for complete search history.

(56) References Cited

U.S. PATENT DOCUMENTS

| | | | | |
|---|---|---|---|---|
| 2,152,306 | A | | 3/1939 | Grebe et al. |
| 2,191,783 | A | | 2/1940 | Wells |
| 2,238,671 | A | | 4/1941 | Woodhouse |
| 2,261,292 | A | | 11/1941 | Salnikov |
| 2,436,036 | A | | 2/1948 | Defenbaugh |
| 2,571,636 | A | | 10/1951 | Watkins |
| 2,703,316 | A | | 3/1955 | Schneider |
| 2,867,170 | A | * | 1/1959 | Kibby ..... 102/319 |
| 2,898,999 | A | | 8/1959 | Carpenter |
| 2,935,020 | A | | 5/1960 | Howard et al. |
| 3,053,182 | A | | 9/1962 | Christopher |
| 3,087,549 | A | | 4/1963 | Brunton |
| 3,099,318 | A | | 7/1963 | Miller et al. |
| 3,173,484 | A | | 3/1965 | Huitt et al. |
| 3,195,635 | A | | 7/1965 | Fast |
| 3,205,947 | A | | 9/1965 | Parker |
| 3,211,232 | A | | 10/1965 | Grimmer |
| 3,302,719 | A | | 2/1967 | Fischer |
| 3,364,995 | A | | 1/1968 | Atkins et al. |
| 3,366,178 | A | | 1/1968 | Malone et al. |
| 3,414,055 | A | | 12/1968 | Vogt, Jr. |
| 3,455,390 | A | | 7/1969 | Gallus |
| 3,768,563 | A | | 10/1973 | Blount |
| 3,784,585 | A | | 1/1974 | Schmitt et al. |
| 3,828,854 | A | | 8/1974 | Templeton et al. |

(Continued)

FOREIGN PATENT DOCUMENTS

EP 0681087 A2 11/1995

(Continued)

OTHER PUBLICATIONS

U.S. Appl. No. 10/435,642, filed May 9, 2003, Swor et al.

(Continued)

*Primary Examiner*—Giovanna C Wright
(74) *Attorney, Agent, or Firm*—John W. Wustenberg; Conley Rose, P.C.

(57) ABSTRACT

A method for removing a sealing plug from a casing or a wellbore according to which a sealing plug is adapted to expand into engagement with the casing or the wellbore. A wireless signal is sent to the plug to cause the plug to lose its structural integrity and fall to the bottom of the wellbore.

25 Claims, 3 Drawing Sheets

U.S. PATENT DOCUMENTS

| | | | |
|---|---|---|---|
| 3,868,998 | A | 3/1975 | Lybarger et al. |
| 3,912,692 | A | 10/1975 | Casey et al. |
| 3,954,438 | A | 5/1976 | Hunter et al. |
| 3,954,788 | A | 5/1976 | Hunter et al. |
| 3,960,736 | A | 6/1976 | Free et al. |
| 3,968,840 | A | 7/1976 | Tate |
| 3,997,277 | A | 12/1976 | Swisher, Jr. et al. |
| 3,998,744 | A | 12/1976 | Arnold et al. |
| 4,023,494 | A | 5/1977 | Barton et al. |
| 4,068,718 | A | 1/1978 | Cooke, Jr. et al. |
| 4,089,035 | A | 5/1978 | Smith |
| 4,099,464 | A | 7/1978 | Cross et al. |
| 4,167,521 | A | 9/1979 | Fowler et al. |
| 4,169,798 | A | 10/1979 | DeMartino |
| 4,178,852 | A | 12/1979 | Smith et al. |
| 4,184,430 | A | 1/1980 | Mock |
| 4,184,838 | A | 1/1980 | Burns et al. |
| 4,187,909 | A | 2/1980 | Erbstoesser |
| 4,237,972 | A | 12/1980 | Lanmon, II |
| 4,262,702 | A | 4/1981 | Streich |
| 4,275,786 | A | 6/1981 | Lee |
| 4,282,034 | A | 8/1981 | Smith et al. |
| 4,286,629 | A | 9/1981 | Streich et al. |
| 4,290,486 | A | 9/1981 | Regalbuto |
| 4,295,424 | A | 10/1981 | Smith et al. |
| 4,298,063 | A | 11/1981 | Regalbuto et al. |
| 4,334,579 | A | 6/1982 | Gregg |
| 4,351,082 | A | 9/1982 | Ackerman et al. |
| 4,378,844 | A | 4/1983 | Parrish et al. |
| 4,387,769 | A | 6/1983 | Erbstoesser et al. |
| 4,417,989 | A | 11/1983 | Hunter |
| 4,424,263 | A | 1/1984 | Howell et al. |
| 4,430,662 | A | 2/1984 | Jillie, Jr. et al. |
| 4,432,419 | A | 2/1984 | Streich |
| 4,442,975 | A | 4/1984 | Long et al. |
| 4,470,915 | A | 9/1984 | Conway |
| 4,498,228 | A | 2/1985 | Jillie, Jr. et al. |
| 4,501,757 | A | 2/1985 | Smith et al. |
| 4,507,082 | A | 3/1985 | Wardlaw, III |
| 4,526,695 | A | 7/1985 | Erbstoesser et al. |
| 4,527,605 | A | 7/1985 | Ede et al. |
| 4,536,414 | A | 8/1985 | Kroger et al. |
| 4,554,567 | A | 11/1985 | Jillie et al. |
| 4,559,708 | A | 12/1985 | Duel et al. |
| 4,593,350 | A | 6/1986 | Mitchell et al. |
| 4,598,769 | A | 7/1986 | Robertson |
| 4,621,562 | A | 11/1986 | Carr et al. |
| 4,633,711 | A | 1/1987 | Hipple et al. |
| 4,655,632 | A | 4/1987 | Smith |
| 4,678,037 | A | 7/1987 | Smith |
| 4,688,641 | A | 8/1987 | Knieriemen |
| 4,700,778 | A | 10/1987 | Smith et al. |
| 4,713,859 | A | 12/1987 | Smith, Jr. |
| 4,715,967 | A | 12/1987 | Bellis et al. |
| 4,716,964 | A | 1/1988 | Erbstoesser et al. |
| 4,743,257 | A | 5/1988 | Törmälä et al. |
| 4,744,630 | A | 5/1988 | Hipple et al. |
| 4,754,417 | A | 6/1988 | Beeson et al. |
| 4,790,385 | A | 12/1988 | McClure et al. |
| 4,803,959 | A | 2/1989 | Sherrick et al. |
| 4,809,783 | A | 3/1989 | Hollenbeck et al. |
| 4,815,160 | A | 3/1989 | Smith, Jr. |
| 4,815,351 | A | 3/1989 | Smith et al. |
| 4,834,184 | A | 5/1989 | Streich et al. |
| 4,843,118 | A | 6/1989 | Lai et al. |
| 4,848,467 | A | 7/1989 | Cantu et al. |
| 4,889,638 | A | 12/1989 | Rockford et al. |
| 4,908,904 | A | 3/1990 | Smith, Jr. |
| 4,957,165 | A | 9/1990 | Cantu et al. |
| 4,961,466 | A | 10/1990 | Himes et al. |
| 4,986,353 | A | 1/1991 | Clark et al. |
| 4,986,354 | A | 1/1991 | Cantu et al. |
| 4,986,355 | A | 1/1991 | Casad et al. |
| 4,995,758 | A | 2/1991 | Smith |
| 5,012,180 | A | 4/1991 | Dalrymple et al. |
| 5,025,412 | A | 6/1991 | Dalrymple et al. |
| 5,032,982 | A | 7/1991 | Dalrymple et al. |
| 5,050,261 | A | 9/1991 | Hofacker |
| 5,070,823 | A | 12/1991 | Ackerman et al. |
| 5,082,056 | A | 1/1992 | Tackett, Jr. |
| 5,090,087 | A | 2/1992 | Hipple et al. |
| 5,113,935 | A | 5/1992 | Jones et al. |
| D327,105 | S | 6/1992 | Smith, Jr. |
| 5,117,911 | A | 6/1992 | Navarette et al. |
| 5,129,322 | A | 7/1992 | Christopher et al. |
| 5,131,472 | A | 7/1992 | Dees et al. |
| 5,153,509 | A | 10/1992 | Dalrymple et al. |
| 5,188,183 | A | 2/1993 | Hopmann et al. |
| 5,193,199 | A | 3/1993 | Dalrymple et al. |
| 5,216,050 | A | 6/1993 | Sinclair |
| 5,220,673 | A | 6/1993 | Dalrymple et al. |
| 5,222,218 | A | 6/1993 | Smith |
| 5,224,540 | A | 7/1993 | Streich et al. |
| 5,248,217 | A | 9/1993 | Smith |
| D340,412 | S | 10/1993 | Smith |
| 5,253,712 | A | 10/1993 | Swor |
| 5,261,488 | A | 11/1993 | Gullet et al. |
| 5,267,533 | A | 12/1993 | Smith |
| 5,271,468 | A | 12/1993 | Streich et al. |
| 5,271,675 | A | 12/1993 | Fagan et al. |
| 5,272,333 | A | 12/1993 | Fagan et al. |
| 5,294,469 | A | 3/1994 | Suzuki et al. |
| 5,309,299 | A | 5/1994 | Crossland et al. |
| 5,318,377 | A | 6/1994 | Swisher, Jr. et al. |
| 5,326,969 | A | 7/1994 | Fagan et al. |
| 5,330,005 | A | 7/1994 | Card et al. |
| 5,333,684 | A | 8/1994 | Walter et al. |
| 5,343,954 | A | 9/1994 | Bohlen et al. |
| 5,390,737 | A | 2/1995 | Jacobi et al. |
| 5,390,966 | A | 2/1995 | Cox et al. |
| 5,404,956 | A | 4/1995 | Bohlen et al. |
| 5,405,212 | A | 4/1995 | Swisher, Jr. et al. |
| 5,435,394 | A | 7/1995 | Robertson |
| 5,439,055 | A | 8/1995 | Card et al. |
| 5,439,059 | A | 8/1995 | Harris et al. |
| 5,440,917 | A | 8/1995 | Smith et al. |
| 5,460,226 | A | 10/1995 | Lawson et al. |
| 5,467,824 | A | 11/1995 | DeMarsh et al. |
| 5,479,986 | A | 1/1996 | Gano et al. |
| 5,488,224 | A | 1/1996 | Fagan et al. |
| 5,492,178 | A | 2/1996 | Nguyen et al. |
| 5,501,274 | A | 3/1996 | Nguyen et al. |
| 5,501,275 | A | 3/1996 | Card et al. |
| 5,505,261 | A | 4/1996 | Huber et al. |
| 5,513,570 | A | 5/1996 | Mulcahy |
| 5,532,249 | A | 7/1996 | Wilkerson et al. |
| 5,540,279 | A | 7/1996 | Branch et al. |
| 5,540,293 | A | 7/1996 | Mohaupt |
| 5,551,514 | A | 9/1996 | Nelson et al. |
| 5,558,153 | A | 9/1996 | Holcombe et al. |
| 5,569,286 | A | 10/1996 | Peckham et al. |
| 5,582,279 | A | 12/1996 | Buchanan, Jr. et al. |
| 5,588,907 | A | 12/1996 | DePietro et al. |
| 5,591,700 | A | 1/1997 | Harris et al. |
| 5,607,017 | A | 3/1997 | Owens et al. |
| 5,607,905 | A | 3/1997 | Dobson, Jr. et al. |
| D381,024 | S | 7/1997 | Hinzmann et al. |
| 5,685,372 | A | 11/1997 | Gano |
| 5,689,085 | A | 11/1997 | Turner |
| D387,865 | S | 12/1997 | Peckham et al. |
| 5,698,322 | A | 12/1997 | Tsai et al. |
| 5,701,959 | A | 12/1997 | Hushbeck et al. |
| 5,709,269 | A | 1/1998 | Head |
| 5,713,621 | A | 2/1998 | Krenkel et al. |

5,720,824 A 2/1998 Bronson et al.
5,740,234 A 4/1998 Black et al.
5,760,250 A 6/1998 Jones et al.
5,763,021 A 6/1998 Young et al.
5,765,641 A 6/1998 Shy et al.
5,775,425 A 7/1998 Weaver et al.
5,783,527 A 7/1998 Dobson, Jr. et al.
5,791,821 A 8/1998 Kiesler
5,829,200 A 11/1998 Jones et al.
5,839,515 A 11/1998 Yuan et al.
5,847,138 A 12/1998 Jones et al.
5,849,401 A 12/1998 El-Afandi et al.
5,888,944 A 3/1999 Patel
5,909,774 A 6/1999 Griffith et al.
D412,062 S 7/1999 Potter et al.
5,931,229 A 8/1999 Lehr et al.
5,934,376 A 8/1999 Nguyen et al.
5,984,007 A 11/1999 Yuan et al.
5,984,573 A 11/1999 Smith
5,990,051 A 11/1999 Ischy et al.
6,016,753 A 1/2000 Glenn et al.
6,021,457 A 2/2000 Archer et al.
6,026,903 A 2/2000 Shy et al.
6,045,420 A 4/2000 Small et al.
6,053,247 A 4/2000 Wesson et al.
6,061,507 A 5/2000 Fitzgerald et al.
6,065,540 A 5/2000 Thomeer et al.
6,092,601 A 7/2000 Gano et al.
6,095,247 A 8/2000 Streich et al.
6,102,117 A 8/2000 Swor et al.
6,110,875 A 8/2000 Tjon-Joe-Pin et al.
6,131,661 A 10/2000 Conner et al.
6,135,987 A 10/2000 Tsai et al.
6,143,698 A 11/2000 Murphey et al.
6,161,622 A 12/2000 Robb et al.
6,162,766 A 12/2000 Muir et al.
6,167,127 A 12/2000 Smith et al.
6,175,490 B1 1/2001 Papa et al.
6,186,226 B1 2/2001 Robertson
6,189,615 B1 2/2001 Sydansk
6,191,032 B1 2/2001 Tiffin et al.
6,195,717 B1 2/2001 Henderson et al.
6,209,646 B1 4/2001 Reddy et al.
6,218,343 B1 4/2001 Burts, Jr.
6,220,345 B1 4/2001 Jones et al.
6,220,349 B1 4/2001 Vargus et al.
6,220,350 B1 4/2001 Brothers et al.
6,237,688 B1 5/2001 Burleson et al.
6,242,390 B1 6/2001 Mitchell et al.
6,249,834 B1 6/2001 Henderson et al.
6,253,334 B1 6/2001 Amdahl et al.
6,263,972 B1 7/2001 Richard et al.
6,287,672 B1 9/2001 Fields et al.
6,318,460 B1 11/2001 Swor et al.
6,323,307 B1 11/2001 Bigg et al.
6,324,608 B1 11/2001 Papa et al.
6,328,105 B1 12/2001 Betzold
6,328,110 B1 12/2001 Joubert
6,334,488 B1 1/2002 Freiheit
6,354,372 B1 3/2002 Carisella et al.
6,357,396 B1 3/2002 Stansfield et al.
6,375,275 B1 4/2002 Smith, Jr. et al.
6,376,524 B1 4/2002 Barr et al.
6,378,606 B1 4/2002 Swor et al.
6,387,986 B1 5/2002 Moradi-Araghi et al.
6,394,180 B1 5/2002 Berscheidt et al.
6,394,185 B1 5/2002 Constien
6,397,950 B1 6/2002 Streich et al.
6,409,219 B1 6/2002 Broome et al.
6,415,712 B1 7/2002 Helland et al.
6,422,314 B1 7/2002 Todd et al.
6,427,775 B1 8/2002 Dusterhoft et al.
6,443,538 B1 9/2002 Smith, Jr. et al.
6,444,316 B1 9/2002 Reddy et al.
6,460,378 B1 10/2002 Dong et al.
6,461,218 B1 10/2002 Mullaney et al.
6,470,835 B1 10/2002 Stansfield et al.
6,481,497 B2 11/2002 Swor et al.
6,491,116 B2 12/2002 Berscheidt et al.
6,494,263 B2 12/2002 Todd
6,520,254 B2 2/2003 Hurst et al.
6,527,051 B1 3/2003 Reddy et al.
6,536,349 B2 3/2003 Patterson et al.
6,536,525 B1 3/2003 Haugen et al.
D473,517 S 4/2003 Overthun et al.
6,554,071 B1 4/2003 Reddy et al.
6,561,270 B1 5/2003 Budde
6,565,955 B2 5/2003 Fields et al.
6,584,336 B1 6/2003 Ali et al.
6,598,679 B2 7/2003 Robertson
6,599,863 B1 7/2003 Palmer et al.
D481,226 S 10/2003 Overthun et al.
6,633,933 B1 10/2003 Smith et al.
6,640,700 B2 11/2003 Helland et al.
6,655,459 B2 12/2003 Mackay
6,666,266 B2 12/2003 Starr et al.
6,666,275 B2 12/2003 Neal et al.
6,667,279 B1 12/2003 Hessert et al.
6,669,771 B2 12/2003 Tokiwa et al.
D485,096 S 1/2004 Overthun et al.
6,681,856 B1 1/2004 Chatterji et al.
6,687,261 B1 2/2004 Skeba et al.
6,695,050 B2 2/2004 Winslow et al.
6,695,051 B2 2/2004 Smith et al.
6,704,408 B2 3/2004 Smith et al.
6,704,991 B1 3/2004 Coulborn et al.
6,710,019 B1 3/2004 Sawdon et al.
6,712,143 B2 3/2004 Robertson
6,742,069 B2 5/2004 Papa et al.
6,761,174 B2 7/2004 Jupe et al.
6,761,218 B2 7/2004 Nguyen et al.
6,770,028 B1 8/2004 Ali et al.
6,772,775 B2 8/2004 Ackerman et al.
6,776,238 B2 8/2004 Dusterhoft et al.
6,782,679 B2 8/2004 Helland et al.
6,792,866 B2 9/2004 Grattan
6,793,018 B2 9/2004 Dawson et al.
6,808,024 B2 10/2004 Schwendemann et al.
6,837,309 B2 1/2005 Boney et al.
6,840,318 B2 1/2005 Lee et al.
6,856,737 B1 2/2005 Parker et al.
6,861,394 B2 3/2005 Ballard et al.
6,862,502 B2 3/2005 Peltz et al.
6,886,635 B2 5/2005 Hossaini et al.
6,895,636 B2 5/2005 Nussbaum
6,896,061 B2 5/2005 Hriscu et al.
6,898,097 B2 5/2005 Dugger et al.
6,925,937 B2 8/2005 Robertson
6,926,086 B2 8/2005 Patterson et al.
6,949,491 B2 9/2005 Cooke, Jr.
6,954,252 B1 10/2005 Crossland et al.
6,959,765 B2 11/2005 Bell
6,966,386 B2 11/2005 Ringgenberg et al.
6,971,449 B1 12/2005 Robertson
6,975,786 B1 12/2005 Warr et al.
6,976,534 B2 12/2005 Sutton et al.
6,997,252 B2 2/2006 Porter et al.
7,013,599 B2 3/2006 Smith et al.
7,027,146 B1 4/2006 Smith et al.
D520,355 S 5/2006 Overthun et al.
7,036,587 B2 5/2006 Munoz, Jr. et al.
7,044,230 B2 5/2006 Starr et al.
7,048,066 B2 5/2006 Ringgenberg et al.
7,049,272 B2 5/2006 Sinclair et al.
7,055,094 B2 5/2006 Imielinski et al.
7,066,258 B2 6/2006 Justus et al.

| | | | | |
|---|---|---|---|---|
| 7,080,688 | B2 | 7/2006 | Todd et al. | |
| 7,093,664 | B2 | 8/2006 | Todd et al. | |
| 7,104,326 | B2 | 9/2006 | Grattan et al. | |
| 7,117,956 | B2 | 10/2006 | Grattan et al. | |
| 7,166,560 | B2 | 1/2007 | Still et al. | |
| 7,168,494 | B2 | 1/2007 | Starr et al. | |
| 7,178,596 | B2 | 2/2007 | Blauch et al. | |
| 7,210,533 | B2 | 5/2007 | Starr et al. | |
| 7,287,592 | B2 | 10/2007 | Surjaatmadja et al. | |
| 7,322,416 | B2 | 1/2008 | Burris, II et al. | |
| 7,353,879 | B2 | 4/2008 | Todd et al. | |
| 7,363,967 | B2 | 4/2008 | Burris, II et al. | |
| 7,393,423 | B2 | 7/2008 | Liu | |
| 2001/0016562 | A1 | 8/2001 | Muir et al. | |
| 2002/0088616 | A1 | 7/2002 | Swor et al. | |
| 2002/0170713 | A1* | 11/2002 | Haugen et al. | 166/298 |
| 2003/0024712 | A1 | 2/2003 | Neal et al. | |
| 2003/0047312 | A1 | 3/2003 | Bell | |
| 2003/0075325 | A1* | 4/2003 | Dusterhoft et al. | 166/279 |
| 2003/0130133 | A1 | 7/2003 | Vollmer | |
| 2003/0168214 | A1 | 9/2003 | Sollesness | |
| 2004/0069485 | A1 | 4/2004 | Ringgenberg et al. | |
| 2004/0221993 | A1 | 11/2004 | Patterson et al. | |
| 2004/0231845 | A1 | 11/2004 | Cooke, Jr. | |
| 2005/0056425 | A1 | 3/2005 | Grigsby et al. | |
| 2005/0126785 | A1 | 6/2005 | Todd | |
| 2005/0173126 | A1* | 8/2005 | Starr et al. | 166/376 |
| 2005/0241835 | A1 | 11/2005 | Burris, II et al. | |
| 2005/0269083 | A1 | 12/2005 | Burris, II et al. | |
| 2005/0274517 | A1 | 12/2005 | Blauch et al. | |
| 2006/0021748 | A1* | 2/2006 | Swor et al. | 166/55 |
| 2006/0070739 | A1 | 4/2006 | Brooks et al. | |
| 2006/0105917 | A1 | 5/2006 | Munoz, Jr. | |
| 2006/0283597 | A1 | 12/2006 | Schriener et al. | |
| 2007/0284097 | A1 | 12/2007 | Swor et al. | |
| 2007/0284114 | A1 | 12/2007 | Swor et al. | |
| 2008/0202764 | A1 | 8/2008 | Clayton et al. | |

FOREIGN PATENT DOCUMENTS

| | | | |
|---|---|---|---|
| EP | 1132571 | A1 | 9/2001 |
| GB | 2 410 964 | | 8/2005 |
| WO | 0057022 | A1 | 9/2000 |
| WO | 0102698 | A1 | 1/2001 |
| WO | 0177484 | A1 | 10/2001 |
| WO | 2004007905 | A1 | 1/2004 |
| WO | 2004037946 | A1 | 5/2004 |
| WO | 2004038176 | A1 | 5/2004 |

OTHER PUBLICATIONS

U.S. Appl. No. 10/765,509, filed Jan. 27, 2004, Starr et al.

Foreign Communcation related to a counterpart application dated Oct. 2, 2007.

Ahmad, M., et al., "Ortho ester hydrolysis: direct evidence for a three-stage reaction mechanism," XP-002322843, 1 page.

Becker, Thomas E., et al., "Drill-in fluid filter-cake behavior during the gravel-packing of horizontal intervals—a laboratory simulation," SPE 50715, International Symposium on Oilfield Chemistry, Houston, U.S.A., Feb. 16-19, 1999, pp. 1-7, Society of Petroleum Engineers, Inc.

Brady, M. E., et al., "Filtercake cleanup in open-hole gravel-packed completions: a necessity or a myth?" SPE 63232, SPE Annual Technical Conference and Exhibition, Dallas, Texas, Oct. 1-4, 2000, pp. 1-12, Society of Petroleum Engineers Inc.

Cantu, Lisa A., et al., "Laboratory and field evaluation of a combined fluid-loss-control additive and gel breaker for fracturing fluids," SPE Production Engineering, Aug. 1990, pp. 253-260, Society of Petroleum Engineers.

Chiang, Y, et al., "Hydrolysis of ortho esters: further investigation of the factors which control the rate-determining step," XP-002322842, 1 page.

Dechy-Cabaret, Odile, et al., "Controlled ring-opening polymerization of lactide and glycolide," Apr. 26, 2004, 30 pages, American Chemical Society.

Demo Lab: The Thermite Reaction, "The general chemistry demo lab—the thermite reaction," http://www.ilpi.com/genchem/demo/thermite/index.html, 2006, 5 pages, Rob Toreki.

Dickinson, W., et al., "A second-generation horizontal drilling system," IADC/SPE 14804, Feb. 10-12, 1986, pp. 673-678 plus 4 pages of drawings, IADC/SPE 1986 Drilling Conference, Dallas, Texas.

Dickinson, W., et al., "Gravel packing of horizontal wells," SPE 16931, 62nd Annual Technical Conference and Exhibition of the Society of Petroleum Engineers, Dallas, Texas, Sep. 27-30, 1987, pp. 519-528, Society of Petroleum Engineers.

Economides, Michael J., et al., "Petroleum well construction," 1998, pp. 8-10, 405-409, 533-534, 537-542, 1 cover page, and 1 publishing page, John Wiley & Sons Ltd., England.

Foreign communication from a related counterpart application—International Search Report, PCT/GB2005/000166, Mar. 17, 2005, 2 pages.

Foreign communication from a related counterpart application—International Search Report, PCT/GB2004/005309, Apr. 13, 2005, 4 pages.

Foreign communication from a related counterpart application—International Preliminary Report on Patentability, PCT/GB 2004/005309, Jul. 10, 2006, 7 pages.

Foreign communication from a related counterpart application—International Search Report and Written Opinion, PCT/GB2005/000995, Jun. 7, 2005, 13 pages.

Foreign communication from a related counterpart application—International Search Report and Written Opinion, PCT/GB2007/002111, Sep. 3, 2007, 11 pages.

Foreign communication from a related counterpart application—International Search Report and Written Opinion, PCT/GB2007/002754, Dec. 10, 2007, 18 pages.

Foreign communication from a related counterpart application—Invitation to Pay Additional Fees, PCT/GB2008/000561, Jun. 3, 2008, 4 pages.

Halliburton brochure entitled "Sand control applications," pp. 2-1 to 2-6, Halliburton Energy Services, Inc.

Heller, J., et al., "Poly(ortho esters)—their development and some recent applications," European Journal of Pharmaceutics and Biopharmaceutics, 2000, pp. 121-128, vol. 50, Elsevier Science B.V.

Heller, J., et al., "Release of norethindrone from poly(ortho esters)," Polymer Sciences Department, SRI International, Menlo Park, California, Mid-Aug. 1981, pp. 727-731, vol. 21, No. 11, Polymer Engineering and Science.

Heller, Jorge, et al., "Poly(ortho esters) for the pulsed and continuous delivery of peptides and proteins," Controlled Release and Biomedical Polymers Department, SRI International, Menlo Park, California, pp. 39-56.

Heller, Jorge, et al., "Poly(ortho esters)—from concept to reality," Biomacromolecules, 2004, pp. 1625-1632, vol. 5, No. 5, American Chemical Society.

Heller, Jorge, et al., "Poly(ortho esters): synthesis, characterization, properties and uses," Advanced Drug Delivery Reviews, 2002, pp. 1015-1039, vol. 54, Elsevier Science B.V.

Lafontaine, Jackie, et al., "New concentric annular packing system limits bridging in horizontal gravel packs," SPE 56778, SPE Annual Technical Conference and Exhibition, Houston, Texas, Oct. 3-6, 1999, pp. 1-11, Society of Petroleum Engineers, Inc.

Ng, S. Y., et al., "Development of a poly(ortho ester) prototype with a latent acid in the polymer backbone for 5-fluorouracil delivery," Journal of Controlled Release, 2000, pp. 367-374, vol. 65, Elsevier Science B.V.

Ng, S. Y., et al., "Synthesis and erosion studies of self-catalyzed poly(ortho ester)s," Macromolecules, 1997, pp. 770-772, vol. 30, No. 4, American Chemical Society.

Office Action dated Jan. 31, 2008 (12 pages), U.S. Appl. No. 11/423,081, filed Jun. 8, 2006.

Office Action dated Jan. 31, 2008 (7 pages), U.S. Appl. No. 11/423,076, filed Jun. 8, 2006.

Office Action (Final) dated Aug. 12, 2008 (12 pages), U.S. Appl. No. 11/423,076, filed Jun. 8, 2006.

Office Action (Final) dated Aug. 12, 2008 (11 pages), U.S. Appl. No. 11/423,081, filed Jun. 8, 2006.
Patent application entitled "Consumable Downhole Tools," by Loren Craig Swor, et al., filed May 13, 2008 as U.S. Appl. No. 12/120,169.
PoroFlex(TM) Expandable Screen Completion Systems, Technology Overview, 2001, 40 pages, Enventure Global Technology, LLC.
Rothen-Weinhold, A., et al., "Release of BSA from poly(ortho ester) extruded thin strands," Journal of Controlled Release, 2001, pp. 31-37, vol. 71, Elsevier Science B.V.
Schlumberger Brochure entitled "STIMPAC Service Brochure," 2000, 8 pages, Schlumberger Limited.
Schwach-Abdellaoui, K., et al., "Control of molecular weight for auto-catalyzed poly(ortho ester) obtained by polycondensation reaction," International Journal of Polymer Anal. Charact., 2002, pp. 145-161, vol. 7, Taylor & Francis.
Schwach-Abdellaoui, K., et al., "Hydrolysis and erosion studies of autocatalyzed poly(ortho esters) containing lactoyl-lactyl acid dimers," Macromolecules, 1999, pp. 301-307, vol. 32, No. 2, American Chemical Society.
Simmons, Tara L., et al., "Poly(phenyllactide): synthesis, characterization, and hydrolytic degradation," Biomacromolecules, 2001, pp. 658-663, vol. 2, No. 3, American Chemical Society.
Skrabal, Anton, et al., "The hydrolysis rate of orthoformic acid ethyl ether," Jan. 13, 1921, pp. 1-38 plus 1 cover page, Translated from German by the McElroy Translation Company, Job No. 415-104489, Ref.: 2004-014178U1, Chemical Institute of the University of Graz.
Todd, B., et al., "A chemical "trigger" useful for oilfield applications," http://www.spe.org/elibinfo/eLibrary_Papers/spe/2005/050CS/00092709/00092709.htm, Paper Preview No. 92709, SPE International Symposium on Oilfield Chemistry, Feb. 2-4, 2005, 2 pages, Society of Petroleum Engineers Inc.
Todd, Brad, et al., "Laboratory device for testing of delayed-breaker solutions on horizontal wellbore filter cakes," SPE 68968, SPE European Formation Damage Conference, The Hague, The Netherlands, May 21-22, 2001, pp. 1-9, Society of Petroleum Engineers, Inc.
Toncheva, V., et al., "Use of block copolymers of poly(ortho esters) and poly(ethylene glycol) micellar carriers as potential tumour targeting systems," Journal of Drug Targeting, 2003, pp. 345-353, vol. 11, No. 6, Taylor & Francis Ltd.
Yin, Mao, et al., "Preparation and characterization of substituted polylactides," Macromolecules, Nov. 16, 1999, pp. 7711-7718, vol. 32, No. 23, American Chemical Society.
Yin, Mao, et al., "Synthesis and properties of polymers derived from substituted lactic acids," Department of Chemistry, Michigan State University, East Lansing, Michigan, 2001, pp. 147-159, American Chemical Society.
Zignani, M., et al., "Subconjunctival biocompatibility of a viscous bioerodable poly(ortho ester)," 1998, pp. 277-285, John Wiley & Sons, Inc.
Office Action dated Dec. 15, 2008 (44 pages), U.S. Appl. No. 11/677,755, filed Feb. 22, 2007.
Office Action dated Mar. 16, 2009 (21 pages), U.S. Appl. No. 11/423,076, filed Jun. 8, 2006.
Office Action dated Mar. 17, 2009 (24 pages), U.S. Appl. No. 11/423,081, filed Jun. 8, 2006.
Office Action dated Mar. 18, 2009 (9 pages), U.S. Appl. No. 12/120,169, filed May 13, 2008.
Rozner, A. G., et al., "Pyronol torch—a non-explosive underwater cutting tool," Offshore Technology Conference, Dallas, Texas, Paper No. OTC 2705, 1976, pp. 1015-1020 plus 2 pages of figures, American Institute of Mining, Metallurgical, and Petroleum Engineers, Inc.

* cited by examiner

METHOD FOR REMOVING A SEALING PLUG FROM A WELL

BACKGROUND

This application relates to a method for removing a sealing plug from a casing or a wellbore in oil and gas recovery operations.

After a well is put into production, a wellhead is usually placed over the well at the ground surface and a closure device, such as a sealing cap, or the like, is provided at the wellhead to prevent the flow of production fluid from the well during certain circumstances. Sometimes, under these conditions, the closure device must be removed for replacement, repair, etc., which creates a risk that some production fluid from the well may flow out from the upper end of the well.

To overcome this, a sealing plug, also referred to as a packer, bridge plug or barrier plug, is usually inserted in the well and activated to plug, or seal, the well and prevent any escape of the production fluid out the top of the well. However, when it is desired to recap the well, the plug must be removed. One common technique for removing the plug is to employ a rig that is used to drill-out the sealing plug, or pull the plug from the well. However, this technique requires sophisticated equipment, is labor intensive, and therefore is expensive.

Another technique to remove the plug from the well is to implant a timing device in the plug to actuate an explosive in the plug after a predetermined time. However, this type of technique has drawbacks since, after these types of plugs have been set in the well, the operator may want to extend the life of the plug from the predetermined time to a longer period of time or even an indeterminate time, and to do so would not be possible.

Therefore, what is needed is a sealing plug of the above type which can be placed in the well to seal off the flow of production fluid as discussed above and yet can be removed at an indeterminate time in a relatively simple and inexpensive manner.

DETAILED DESCRIPTION

Figure 1:
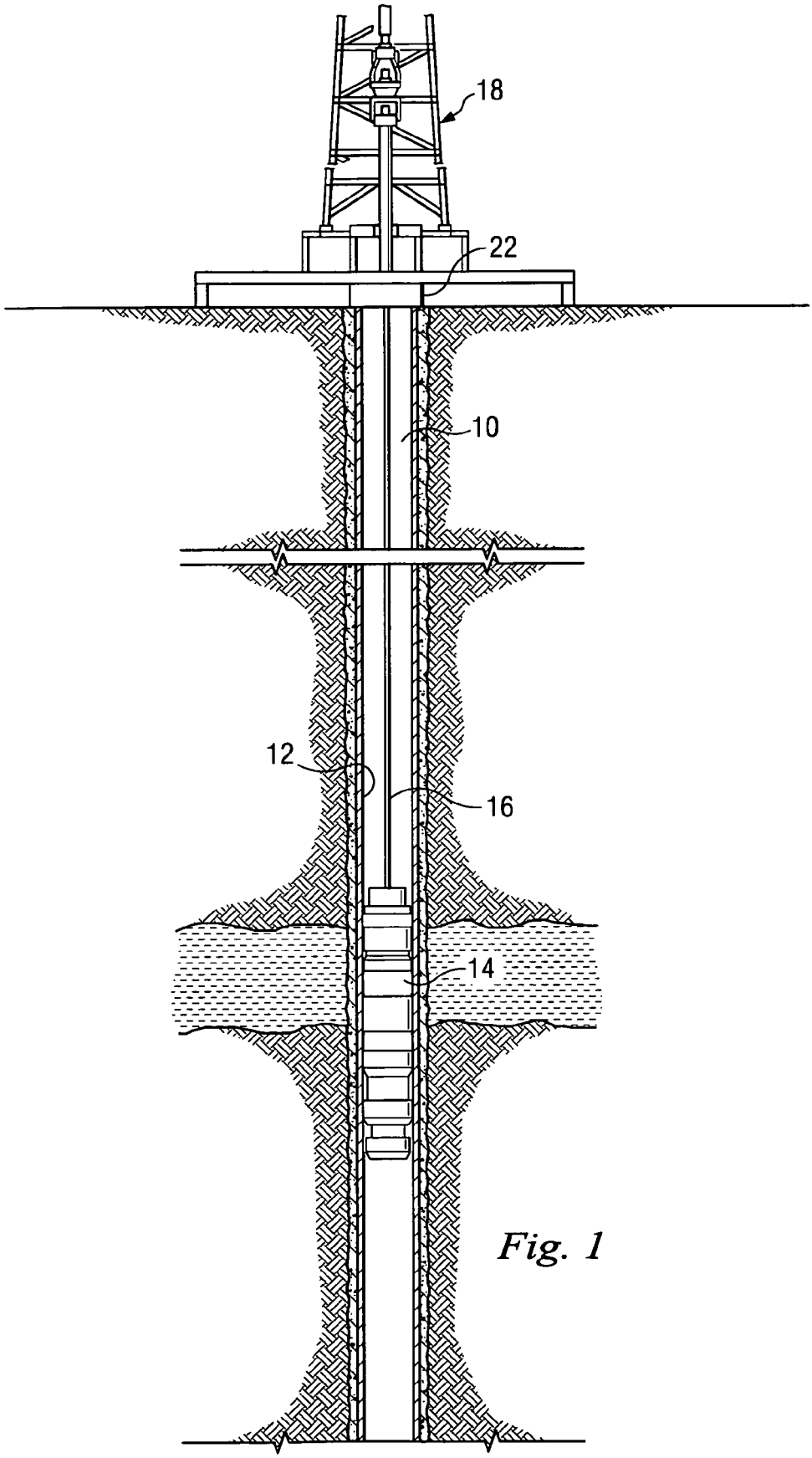
FIG. 1 is a schematic/elevational/sectional view of an oil and gas recovery operation including a sealing plug according to an embodiment of the invention.

Referring to FIG. 1, the reference numeral 10 refers to a wellbore penetrating a subterranean formation for the purpose of recovering hydrocarbon fluids from the formation. The wellbore 10 could be an open hole completion or a cased completion, and in the latter case a casing 12 would be cemented in the wellbore 10 in a conventional manner.

A sealing plug, or sealing tool, 14 is disposed in the wellbore 10 at a predetermined depth and is lowered to this position by a work string 16, in the form of coiled tubing, jointed tubing, wire line, or the like, which is connected to the upper end of the plug 14. The plug 14 is shown generally in FIG. 1 and will be described in detail later.

The work string 16 extends from a rig 18 located above ground and extending over the wellbore 10. The rig 18 is conventional and, as such, includes a support structure, a motor driven winch, or the like, and other associated equipment for lowering the plug 14, via the string 16, into the wellbore 10.

The string 16 extends through a wellhead 22 that is positioned over the upper end of the wellbore 10 and the casing 12 at the rig 18. The wellhead 22 is conventional and, as such, includes a closure device (not shown), such as a cap, or the like, for preventing the flow of production fluid from the formation through the casing 12, while permitting movement of the string 16, in a conventional manner.

When the well is not in production, the above-mentioned closure device associated with the wellhead 22 is set to prevent any flow of production fluid from the formation and through the casing 12 to the rig 18. However, if the closure device has to be removed for repair, replacement, or the like, the casing 12 must be sealed to prevent the production fluid flow. To this end, the plug 14 is lowered, via the string 16, to a desired depth in the casing 12 adjacent to, or above, the formation, such as to the depth shown in FIG. 1, and the plug 14 is set in the casing 12 in a manner to be described.

Figure 2:
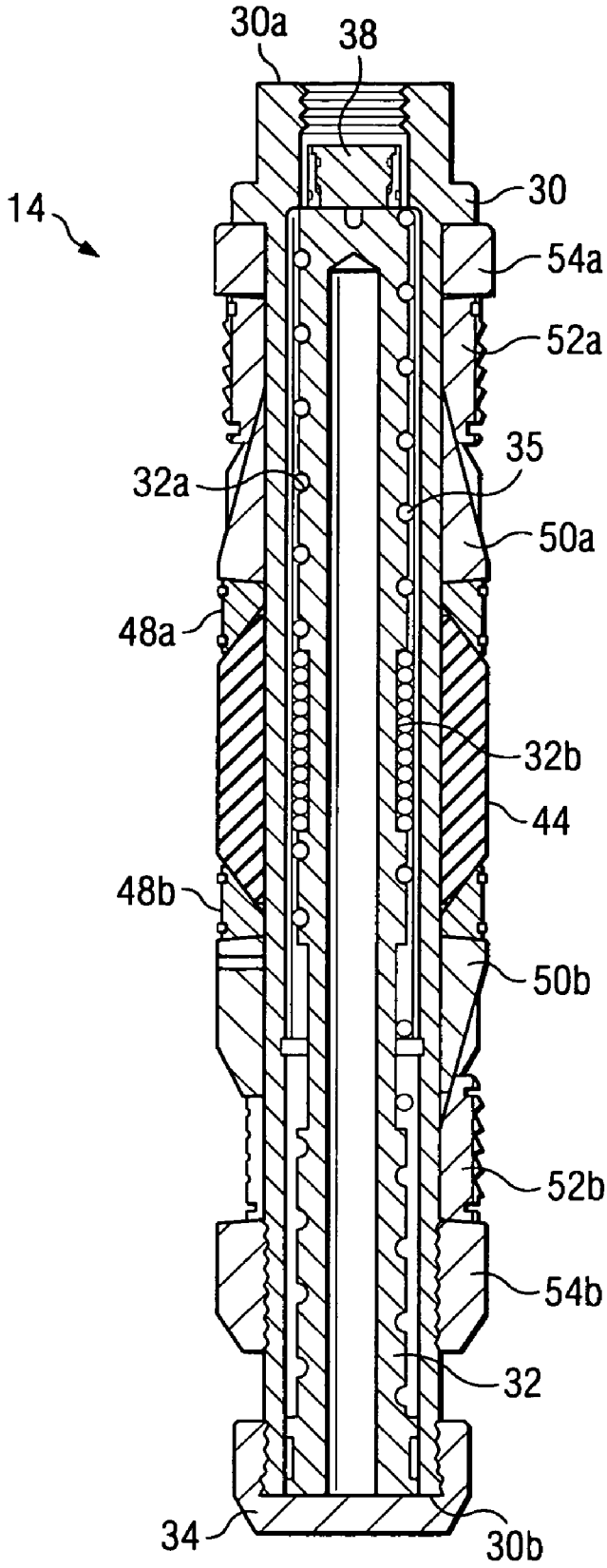
FIG. 2 is an enlarged, sectional view of the plug of FIG. 1.

With reference to FIG. 2, the plug 14 includes a mandrel 30 having an upper end 30*a* that is connectable to the lower end of the string 16 in any conventional manner. The mandrel 30 has a lower end 30*b*, and a continuous bore extends between the upper end 30*a* and the lower end 30*b*.

A tubular liner 32 is disposed in the bore of the mandrel 30, with the lower end of the liner 32 extending flush with the lower end 30*b* of the mandrel 30. A cap 34 extends over the lower end 30*b* of the mandrel 30 and the corresponding end of the liner 32 to retain the liner 32 in the mandrel 30.

A series of axially-spaced circumferential grooves 32*a* are formed in the outer surface of the liner 32 which receive a detonation cord 35 that extends around the liner 32. The detonation cord 35 is of a conventional design and, as such, can be a thin, flexible, waterproof fabric tube with a highly explosive core that can transmit a detonation wave. The cord 35 is wrapped around the liner 32 and extends in the grooves 32*a*, and also is more tightly wrapped in an enlarged recess 32*b* formed in the liner 32. A conventional detonation initiator 38 abuts the upper end of the liner 32, and, when activated in a manner to be described, detonates the cord 35, causing the explosive in the cord to explode.

A compression-set, annular sealing element 44 extends around the mandrel 30 and is axially positioned between two sets of extrusion limiters 48*a* and 48*b*. A pair of wedges 50*a* and 50*b* extend between the extrusion limiters 48*a* and 48*b*, respectively, and two sets of slips 52*a* and 52*b*, respectively. The inner surfaces of the end portions of the slips 52*a* and 52*b* adjacent the wedges 50*a* and 50*b* are beveled so as to receive the corresponding tapered end portions of the wedges 50*a* and 50*b*. The sealing element 44 can be fabricated from a conventional material that performs the sealing function to be described, and the slips 52*a* and 52*b* and the mandrel 30 are preferably fabricated from a frangible material.

A mechanism for expanding and setting the sealing element 44 and the slips 52*a* and 52*b* includes a pair of axially-spaced ratchet shoes 54*a* and 54*b* that extend around the mandrel 30 and abut the corresponding ends of the slips 52*a* and 52*b*. Since the extrusion limiters 48*a* and 48*b*, the wedges 50*a* and 50*b*, the slips 52*a* and 52*b*, and the shoes 54*a* and 54*b* are conventional, they will not be described in further detail.

The sealing element 44 and the slips 52*a* and 52*b* are activated, or set, in a conventional manner by using a setting tool, or the like (not shown), to move the shoe 54*a* downwardly relative to the mandrel 30, as viewed in FIG. 2, and to move the shoe 54*b* upwardly relative to the mandrel 30. This places a compressive force on the assembly formed by the slips 52*a* and 52*b*, the wedges 50*a* and 50*b* and the sealing element 44. As a result, the slips 52*a* and 52*b* are forced radially outwardly into a locking engagement with the inner wall of the casing 12, and the sealing element 44 expands radially outwardly into a sealing engagement with the inner wall of the casing 12. Thus, the plug 14 seals against any flow of production fluid from the formation through the wellbore 10. After the plug 14 is set in the above manner, the string 16 (FIG. 1) is disconnected from the plug 14 in any conventional manner, and the string 16 is brought to the ground surface by the winch of the rig 18.

Figure 3:
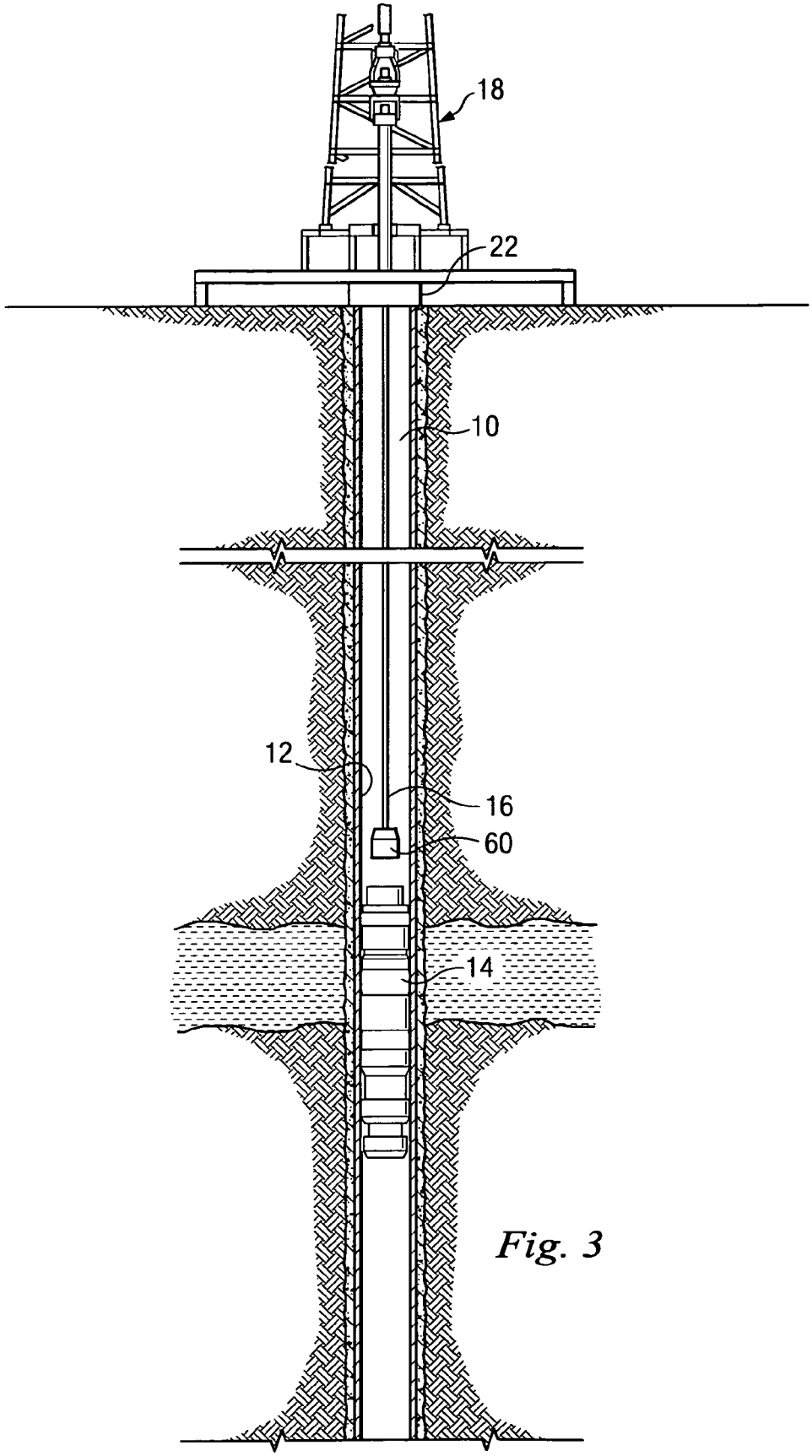
FIG. 3 is a view, similar to that of FIG. 1, but depicting a different operational mode.

When it is desired to recap the well, the plug 14 is removed in the following manner. Referring to FIG. 3, an actuator 60 is connected to the leading end of the string 16 in any conventional manner. The string 16 is then lowered into the wellbore 10 until the actuator 60 extends above, and in proximity to, the plug 14 and, more particularly, the initiator 38 (FIG. 2). The actuator 60 is adapted to transmit, and the initiator 38 is adapted to receive, a wireless signal, or code, for activating the initiator 38. In particular, the actuator 60 includes a transmitting antenna (not shown) that is adapted to transmit the signal to the initiator 38, and the initiator 38 includes a receiving antenna that receives the transmitted signal from the actuator 60. The signal transmitted between the actuator 60 and the initiator 38 is adapted to activate the initiator 38 and can be of any conventional type, such as electrical, acoustical, or magnetic.

The activation of the initiator 38 by the above signal detonates the cord 35 and explodes the explosive associated with the cord 35. The explosion disintegrates, or breaks up at least a portion of the plug 14 and releases the engagement of the plug 14 with the casing 12 or the wellbore 10. The resulting fragments of the plug 14 fall to the bottom of the wellbore 10 by gravity. The string 16 (FIG. 3), with the actuator 60, is then brought to the ground surface by the winch of the rig 18 (FIG. 1).

The above-mentioned closure device associated with the wellhead 22 is then reinstalled over the wellhead 22 and set to prevent any flow of production fluid from the formation and through the wellbore 10 to the rig 18.

Thus, the plug 14 can be placed in the wellbore 10 and activated to seal off the flow of production fluid as discussed above and yet can be removed in a relatively simple and inexpensive manner at any indeterminate time.

According to an alternate embodiment, the initiator 38 responds to the signal from the actuator 60 and produces heat and oxygen in a manner to be described, and one or more of the components of the plug 14 are formed from a consumable material that burns away and/or loses structural integrity when exposed to the heat and oxygen.

In particular, the initiator 38 includes what is commonly referred to as an "exploding bridge wire" that is surrounded by a material that produces heat and oxygen when ignited by the wire. In particular the bridge wire consists of a wire that is connected across a source of high-voltage electricity so that when activated, the resulting high current generates heat in the wire that is transferred to, and is sufficient to ignite, the material. An example of such a material is thermite, which comprises iron oxide, or rust ($Fe_2O_3$), and aluminum metal powder (Al). When ignited and burned, the thermite reacts to produce aluminum oxide ($Al_2O_3$), and liquid iron (Fe), which is a molten plasma-like substance. The chemical reaction is:

$$Fe_2O_3+2Al(s)\rightarrow Al_2O_3(s)+2Fe(1)$$

As stated above, one or more of the components of the plug 14 is formed from a consumable material that burns away and/or loses its structural integrity when exposed to the heat and oxygen resulting from the burning of the thermite. The components of the plug 14 that may be formed of the consumable material should be suitable for service in a downhole environment and provide adequate strength to enable proper operation of the plug 14. By way of example only, the mandrel 30 and/or the slips 52*a* and 52*b* of the plug can be fabricated of a consumable material, and an example of the latter material is magnesium metal.

After the plug 14 is installed in the wellbore 10, and if it is desired to remove the plug for the same reasons as indicated in the previous embodiment, the actuator 60 is attached to the end of the string 16, and the string 16 is lowered into the wellbore 10 until the actuator 60 extends above, and in proximity to, the plug 14 and, more particularly, the initiator 38 (FIG. 2). The initiator 38 is activated by the transmitted wireless signal, or code, from the actuator 60, as described above.

Activation of the initiator 38 produces a high current across the above described bridge wire which generates heat sufficient to ignite, or burn, the material, such as thermite, surrounding the bridge wire, thus producing heat and oxygen. The consumable components of the plug 14, which in the above example are the mandrel 30 and/or the slips 52*a* and 52*b*, will react with the oxygen in the aluminum oxide ($Al_2O_3$), causing the magnesium metal to be consumed or converted into magnesium oxide (MgO), as illustrated by the chemical reaction below:

$$3Mg+Al_2O_3\rightarrow 3MgO+2Al$$

A slag is thus produced such that the mandrel 30 and/or the slips 52*a* and 52*b* no longer have structural integrity and thus cannot carry the load. The engagement of the plug 14 with the casing 12 or the wellbore 10 is released and the resulting slag and/or fragments of the mandrel 30 and the slips 52*a* and 52*b*, along with the remaining components of the plug 14, fall to the bottom of the wellbore 10 by gravity.

The string 16 , with the actuator 60 (FIG. 3), is then brought to the ground surface by the winch of the rig 18 (FIG. 1). The above-mentioned closure device associated with the wellhead 22 (FIG. 1) is then reinstalled over the wellhead 22 and set to prevent any flow of production fluid from the formation and through the wellbore 10 to the rig 18.

Thus, as in the previous embodiment, the plug 14 can be placed in the wellbore 10 and activated to seal off the flow of production fluid as discussed above and yet can be removed in a relatively simple and inexpensive manner at any indeterminate time.

Variations

It is understood that variations may be made in the foregoing without departing from the scope of the invention. Non-limiting examples of these variations are as follows:

(1) The number and type of the slips 52*a* and 52*b* and the sealing element 44 can be varied within the scope of the invention.

(2) The type of electronic signal transmitted from the actuator 60 to the initiator 38 to activate the initiator 38 can be varied and can be generated by electrical, acoustical, or magnetic devices, in a conventional manner.

(3) The initiator 38 could be activated by mechanical means such as a fishing head attachment that is operated by a hook, or the like, attached to the string 16.

(4) The wellbore 10 could be an open hole completion, sans the casing 12, in which case the wellbore 10 would be sealed by the plug 14.

(5) The signal transmitted to the initiator 38 could be transmitted from the ground surface.

(6) In the second embodiment disclosed above, components, other than the slips 52*a* and 52*b* and the mandrel 30 may be fabricated from the consumable material that loses structural integrity when exposed to heat and an oxygen source.

(7) The consumable components of the plug 14 can be fabricated from a material other than magnesium metal.

(8) Conventional blasting caps can be used in place of the bridge wire discussed above.

(9) The plug 14 can used in other well servicing or well treatment operations when temporary plugging of the well is needed such as in fracturing operations.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A method for sealing a casing or a wellbore, comprising:
providing an explosive on a sealing plug;
providing an initiator on the plug to receive the wireless signal and to initiate exploding of the explosive in response to receiving a wireless signal;
lowering the plug into the casing or the wellbore;
expanding the plug into engagement with the casing or wellbore to provide a seal;
lowering an actuator into the wellbore; and
transmitting a wireless signal from the actuator to the initiator to explode the explosive and release the engagement;
wherein the explosive comprises a cord at least partially received within a recess of a liner of the plug.

2. The method of claim 1, wherein the cord is wrapped around the liner within the recess and is more tightly wrapped around the liner adjacent a sealing element of the plug.

3. The method of claim 1, wherein the recess is configured to receive at least two longitudinally adjacent wrappings of the cord.

4. A method for sealing a casing or a wellbore, comprising:
providing a sealing plug having at least one consumable component;
lowering the plug into the casing or the wellbore;
expanding the plug into engagement with the casing or wellbore to provide a seal;
lowering an actuator into the wellbore; and
transmitting a wireless signal from the actuator to the plug to initiate ignition; and
igniting thermite in response to transmitting the wireless signal, thereby producing heat and oxygen, wherein the heat and oxygen at least partially consume the at least one consumable component of the plug to cause the plug to release the engagement.

5. The method of claim 4, wherein igniting the thermite comprises placing the material in proximity to a wire, and applying a voltage to the wire to produce heat sufficient to ignite the thermite.

6. The method of claim 4, further comprising providing an initiator on the plug to receive the wireless signal and to initiate the production of heat and oxygen.

7. The method of claim 4, wherein at least one component of the plug is fabricated from a magnesium metal that consumes in the presence of the heat and oxygen.

8. The method of claim 4, further comprising:
lowering the plug into the wellbore by a string;
releasing the plug from the string; and
removing the string from the wellbore;
wherein lowering the actuator comprises connecting the actuator to the string and lowering the string and the actuator into the wellbore.

9. The method of claim 4, wherein the at least partial consumption of the at least one consumable component of the plug causes the plug to lose its structural integrity and release the engagement, and the at least partially consumed at least one consumable component, along with the remaining components of the plug, fall to the bottom of the wellbore by gravity.

10. A method for sealing a casing or a wellbore, comprising:
providing a sealing plug having an explosive on the sealing plug, the explosive comprising a cord wrapped around a liner of the plug and the cord comprising an increased density of windings about the liner adjacent a sealing element of the plug;
lowering the sealing plug into the casing or the wellbore;
expanding the plug into engagement with the casing or wellbore to provide a seal;
lowering an actuator into the wellbore;
transmitting a wireless signal from the actuator to the plug; and
causing at least one component of the plug to loose its structural integrity in response to transmitting the wireless signal to cause the plug to release the engagement.

11. The method of claim 10, wherein the explosive is ignited in response to transmitting the wireless signal to cause the plug to lose it structural integrity.

12. The method of claim 10, further comprising providing an initiator on the plug to receive the wireless signal and to ignite the explosive.

13. A method for sealing a casing or a wellbore, comprising:
providing an explosive on a sealing plug;
providing an initiator on the plug;
lowering the plug into the casing or the wellbore;
expanding the plug into engagement with the casing or wellbore to provide a seal;
lowering an actuator into the wellbore and transmitting a wireless signal from the actuator to the initiator; and
receiving the wireless signal with the initiator to initiate the exploding of the explosive to release the engagement in response to receiving the wireless signal.

14. The method claim 13, further comprising:
lowering the plug into the wellbore by a string;
releasing the plug from the string; and
removing the string from the wellbore;
wherein lowering the actuator comprises connecting the actuator to the string and lowering the string and the actuator into the wellbore.

15. The method of claim 13, wherein the explosion disintegrates, or breaks up, at least a portion of the plug to release the engagement, and the resulting fragments of the plug fall to the bottom of the wellbore by gravity.

16. A method for sealing a casing or a wellbore, comprising:
providing a sealing plug having at least one consumable component;
lowering the plug into the casing or the wellbore;

expanding the plug into engagement with the casing or wellbore to provide a seal;

lowering an actuator into the wellbore;

transmitting a wireless signal from the actuator to the plug; and igniting a material in response to transmitting the wireless signal, thereby causing the material to producing heat and oxygen, wherein the heat and oxygen consumes the at least one consumable component of the plug to cause the plug to release the engagement.

17. The method of claim 16, wherein the material is thermite.

18. A method for sealing a casing or a wellbore, comprising:

lowering a sealing plug into the casing or the wellbore;

expanding the plug into engagement with the casing or wellbore to provide a seal;

lowering an actuator into the wellbore;

transmitting a wireless signal to the plug from the actuator; and causing at least one component of the plug to loose its structural integrity in response to transmitting the wireless signal to cause the plug to release the engagement.

19. The method of 18, wherein a material is ignited in response to the transmission of the wireless signal and produces heat and oxygen, and at least one component of the plug is consumed by the heat and oxygen to cause the plug to lose its structural integrity.

20. The method of claim 19, further comprising providing an initiator on the plug to receive the wireless signal and to initiate the production of the heat and oxygen.

21. The method of claim 20, wherein at least one component of the plug is fabricated from a magnesium metal that consumes in the presence of the heat and oxygen.

22. The method of claim 19, wherein the material is thermite.

23. The method of claim 18, further comprising:

lowering the plug into the wellbore by a string;

releasing the plug from the string; and removing the string from the wellbore;

wherein lowering the actuator comprises connecting the actuator to the string and lowering the string and the actuator into the wellbore.

24. The method of claim 18, wherein an explosive is ignited in response to transmitting the wireless signal to cause the plug to lose it structural integrity.

25. The method of claim 24, further comprising providing an initiator on the plug to receive the wireless signal and to ignite the explosive.

* * * * *

UNITED STATES PATENT AND TRADEMARK OFFICE

CERTIFICATE OF CORRECTION

PATENT NO. : 7,591,318 B2
APPLICATION NO. : 11/489853
DATED : September 22, 2009
INVENTOR(S) : Stephen E. Tilghman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 243 days.

Signed and Sealed this

Twenty-first Day of September, 2010

David J. Kappos

David J. Kappos
*Director of the United States Patent and Trademark Office*